United States Patent [19]

Corompt

[11] Patent Number: 4,848,619

[45] Date of Patent: Jul. 18, 1989

[54] DEVICE FOR THE HANDLING OF A CONTAINER

[75] Inventor: Antoine Corompt, Saint-Etienne, France

[73] Assignee: Bennes Marrel, France

[21] Appl. No.: 168,269

[22] Filed: Mar. 15, 1988

[30] Foreign Application Priority Data

Apr. 4, 1986 [FR] France ..... 86 05476

[51] Int. Cl.[4] ..... B65D 88/12

[52] U.S. Cl. ..... 220/1.5; 414/498

[58] Field of Search ..... 414/491, 546, 547, 555, 414/498; 220/94 R, 1.5

[56] References Cited

U.S. PATENT DOCUMENTS 3,984,013 10/1976 Wirz ..... 414/498 X

FOREIGN PATENT DOCUMENTS 3312557 10/1984 Fed. Rep. of Germany ..... 414/498
58-97534 6/1983 Japan ..... 414/498
58-141943 8/1983 Japan ..... 414/498

*Primary Examiner*—Andres Kashnikow
*Assistant Examiner*—Kevin P. Weldon
*Attorney, Agent, or Firm*—Arnold S. Weintraub

[57] ABSTRACT

A removable support with a transverse hooking bar for equipping a front panel of a container, having a front panel and an upper panel, to receive a hook of a swinging cross piece bracket, adapted to fit a transportation and handling vehicle, wherein a transverse hooking bar of the movable support receives a handling hook which is connected to the vehicle. The hooking bar is thereby disposed on the front panel, connected to the removable support. The container is locked into place by an eclipsible lock, but at the same time the removable support can be unlocked, allowing access to the front panel of the container. The removable support can pivot about an axis to a horizontal position on the upper panel of the container where it may be locked into place. The support is vertically moveable on the front panel and may be secured at the top or bottom of the panel by means of the eclipsible lock. A swinging door located on the front panel is made accessible by use of the removable support.

18 Claims, 4 Drawing Sheets

DEVICE FOR THE HANDLING OF A CONTAINER

Figure 1:
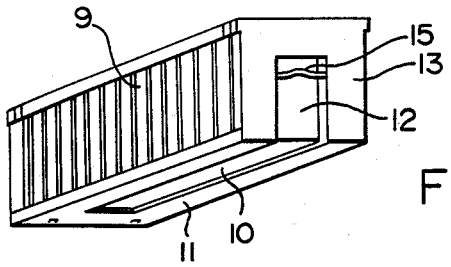
Figure 2:
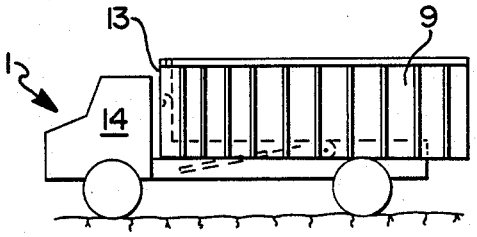
Figure 3:
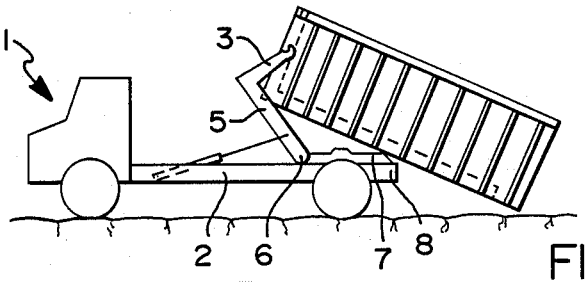
Figure 4:
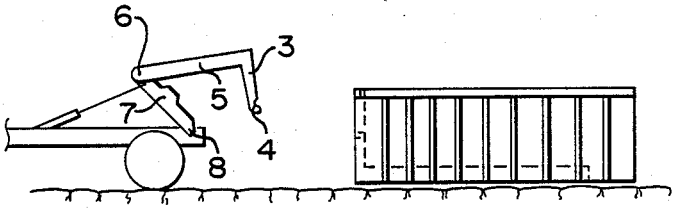
Figure 5:
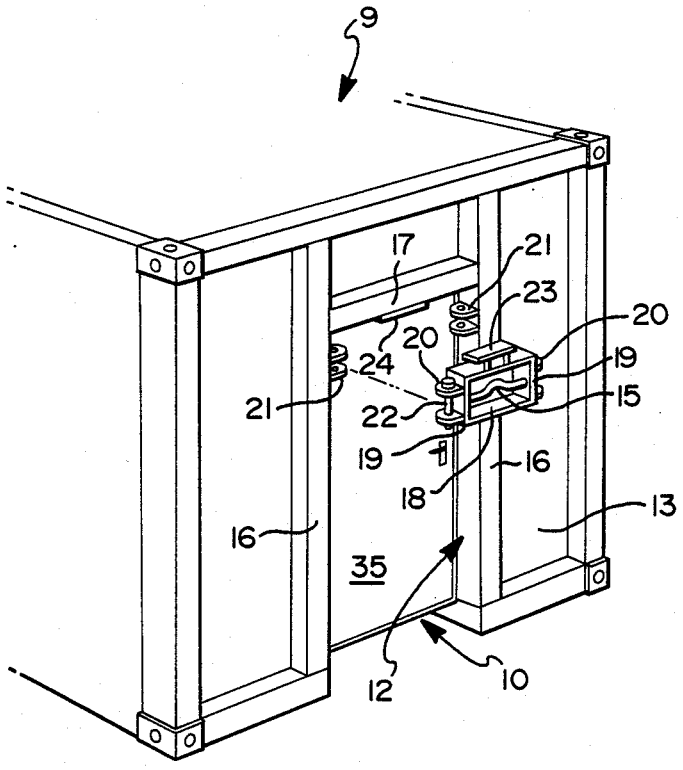
Figure 6:
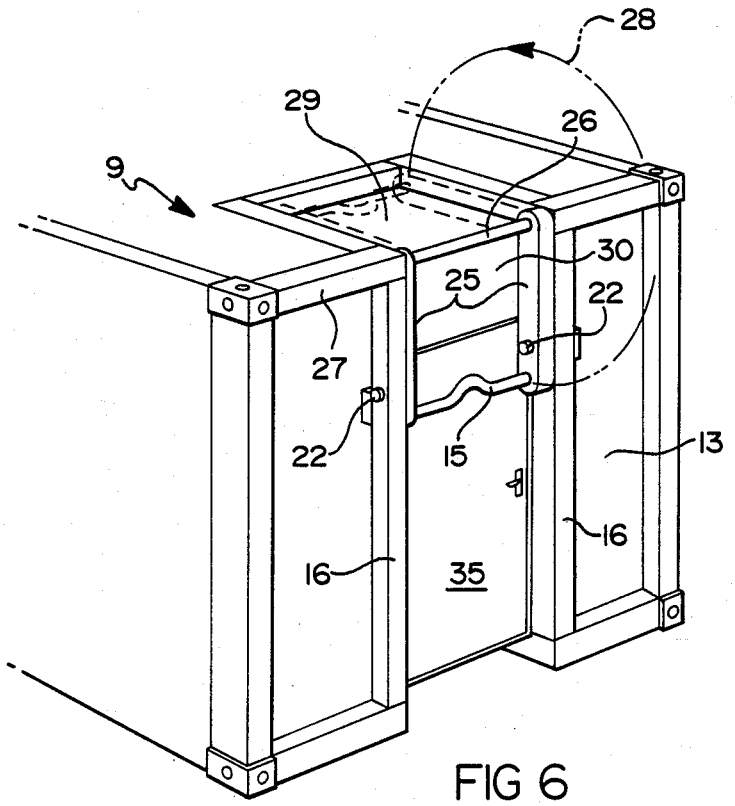
Figure 7:
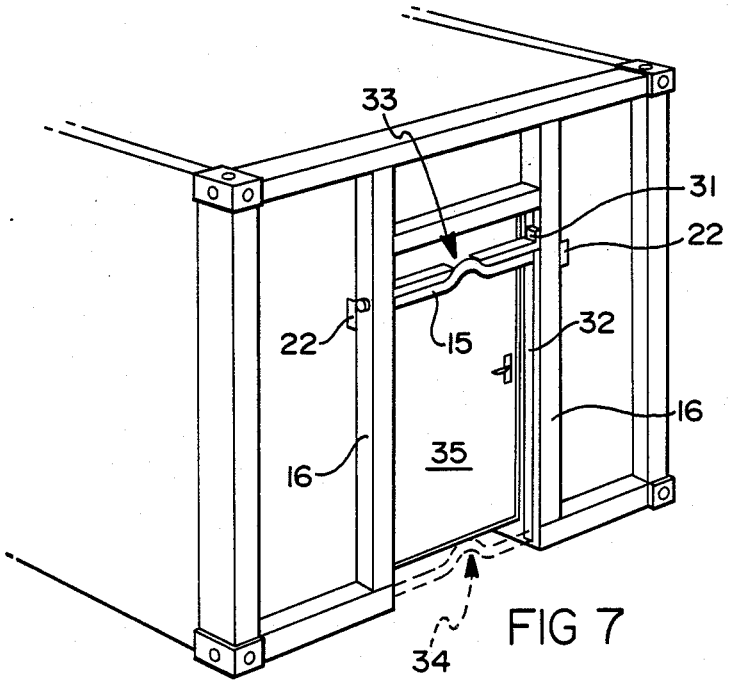

This invention is comparable to a new type of device destined to fit the vertical panel at the front of a parallelepiped container to allow its handling from the lifting hook of a known handling apparatus, in all leaving the panel in front of the container available for other uses, notably for the implantation of an open door.

From French Pat. No. 2,858,352, one is familiar with a handling apparatus with hydraulic arms, which comprises a telescopic jib (arm) hinged on a subframe which rocks or sways on the bottom of a truck frame. This device is designed to manipulate a parallelepiped container whose exterior sides correspond to the international standard "ISO." One knows that this container includes a niche (recess) sunken in the vertical panel in front of the container, and a longitudinal tunnel sunken under the lower face or bed of the container. Close to the upper part of the first niche, a transversal axis or handle is provided for and is rigidly fixed to receive the handling of a truck's lifting hook. This lifting handle, being mounted at a fixed post, and unnecessarily fixed on rigid and solid parts of the container, renders the front panel unavailable for the installation of accessories, such as a door.

This invention is intended to avoid these inconveniences in achieving, in a standardized way, a parallelepiped container whose front can be manipulated by a standard handling apparatus with a hydraulic arm, therefore the front panel of the container will remain available for the installation of different accessories, notably an access door to the interior of the container.

An apparatus according to the invention is intended to equip the front panel of a provided container, in this location, of a transversal hooking bar, to receive the hook of a swinging jib which, in a known fashion, equips a transportation and handling vehicle; and is characterized such that the hooking bar is integral with a removable support such that the methods of bypassing the locking mechanism, voluntarily permitting secure locking on the container, for handling/storing operations, and for unlocking for opening the removable support which renders the container's front panel available.

Another characteristic of the invention, is that the removable support is locked in the niche vertically set out in the hollow vertical panel in front of the container.

In accordance with another feature of the invention, the niche is arranged between two vertical rigid columns upon which the means of eclipsable locking permit the locking of the removable support.

In accordance with another characteristic of the invention, the removable support is made up of a vertical frame, more or less rectangular which, more or less according to its horizontal median is responsible for the hooking bar, such that the exterior of the two vertical sides, the means of the eclipsable locking mechanism, assures an immobilization on the two vertical columns of the container between which this frame can embed itself.

According to another characteristic of the invention, the removable support is made up of a tilting or swinging frame that is more or less rectangular, as one of the sides is made up by the horizontal hooking bar such that the opposite side forms a pivot axis integral with the upper horizontal line at the front of the container.

According to another characteristic of the invention, the aforementioned tilting or swinging frame is provided for resilient means of return (readjustment) which tends to return in upper position, horizontally folded back on the upper panel of the container. The hooking bar therefore being situated to the extreme back of the frame.

According to another characteristic of the invention, the upper part in front of the container is made up of two hollow niches to receive the swinging or tilting hooking frame to wit:

- a first niche at the upper part of the front vertical panel, to receive the frame when it is in vertical handling position, with the hooking bar located at the bottom;
- a second niche, hollowed on the front of the horizontal upper panel, to receive the swinging or tilting frame where it is in the eclipsed position on the top of the container; it's extreme back carrying the handling bar.

According to another characteristic of the invention, the removable support is made up of two grooved bases each movable in one of the two vertical side sills (of the frame), these two bases being connected by the horizontal hooking bar, with which they constitute a vertically moving cart between the two groves that fit the columns of the container.

According to another characteristic of the invention, the aforementioned cart can lower itself just to a low position, where the hooking bar is located in proximity to the horizontal lower line.

According to another characteristic of the invention, the eclipsable locking mechanism is made up of movable hinge pins that one inserts in the lodgings situated opposite on the vertical columns of the container and on the vertical sides of the removable support, cart, tilting column or removable column.

According to another characteristic of the invention, the vertical panel in front of the container is equipped with an access door, where the swing door is set out between the principle niche's two vertical columns.

The attached design, given as an unlimited example, will permit one to better understand the characteristics of the invention.

Diagram 1 is a perspective view showing a container standardized according to the invention.

Diagrams 2 through 4 illustrate the handling and transporting phases of this container, when one can manipulate it with a known apparatus of the type called a "hydraulic arm" that fits a truck.

Diagram 5 shows a first possible variation, for the realization of a removable swing support on the front of the container.

Diagram 6 shows a second variation where the swing bar fits a tilting or swinging frame.

Diagram 7 shows a third variation where the swing bar is carried by a vertical sliding cart.

The diagrams represent a truck (1) whose chassis (2) is equipped with a handling apparatus of a known type with a hydraulic arm. This apparatus is notably made up of a lifting support whose upper arm (3) carries, at its top, a handling hook (4), such that its lower arm (5) is articulated by an axis (6), on the front of an adjustable false chassis or small rod (7). The latter is articulated in (8), on the rear of chassis (2) on the truck (1). Truck (1), also so equipped, is provided to assure loading, (Diagrams 4 and 3), transport (Diagram 2) and the handling of a parallelepiped container (9). The latter conforms to the international standard "ISO". In other respects, as already acknowledged by the French Pat. No. 2,358,352, one knows that the container (9) provides for two main niches, namely:

a lower niche (10), provided in hollow under its lower horizontal panel or bed (support) (11);

an upper front niche (12), provided in hollow on the front vertical panel (13).

At its lower part, the main niche (12) comes out onto the lower niche (10).

These two niches (10 and 12) are provided to receive respectively, the support arms (5 and 3) when the container (9) is on truck (1) in transporting position (Diagram 2). In this case, the front panel (13) is situated immediately behind the cabin (14) of the truck (1).

In the main niche (2), and at its upper part is fixed a transverse hooking bar (15), provided to receive the handling hook (4).

On the standard containers (9), the hooking bar (15) is rigidly integral with the container, in other words, fixed in a irremovable way.

According to the present invention, the hooking bar (15) is, on the contrary, fixed in removable fashion, as illustrated in diagrams 5 and 7.

In the case of Diagram 5, the main niche (12) is defined in hollow between two rigid vertical columns (16). The latter are joined between them by a tightening cross bar (17), located above the given site for hooking bar (15). The latter one is integral with a rectangular framework case (18) comprising two horizontal side members and horizontal top and bottom members, where the hooking bar approximately houses the placement of the horizontal median.

At the outside of the two vertical sides (19) of the case (18), the pinning yokes are provided for (20), susceptible to be brought up coinciding with the fixed yokes (21) responsible for the interior walls opposite the columns (16) to lock the fixture into place on the front panel of the container.

When the rectangular case (18) is embedded between the two columns (16) in the handling position, it suffices to put the removable pins (22) in place in order to lock the case (18) tightly on the columns (16).

At its upper part, the case (18) comprises a horizontal supporting bed plate (23), susceptible of coming to support itself against the lower face of the (frame's) cross member (17), for example at the level of a bed plate (24).

In the diagram 6 variation, the horizontal hooking bar's (15) removable support is made up of a tilting (swinging) frame whose arm (25) pivots around the pivotal axis (26) situated at the level of the upper edge/-line (27), in front of the container (9).

The return or drawback springs not shown, resiliently spring toward the top of (arrow 28) the swinging-/tilting frame (15, 25, 26). When horizontally folded back at the top of the container (9), (interrupted pulling position), the frame is incorporated into the container (9) in a second retraction niche (29) provided for this effect. On the other hand, when it is folded back toward the bottom in active position (in full pull) the frame finds itself in a first niche (30) hollowed at the top of the vertical panel (13), at the bottom of the principle niche (12). The latter can be the simple extension toward the bottom of niche (30), between the columns (16).

In Diagram 7's variation, the hooking bar (15) is integral with each extremity, from a base (31) that vertically slides in a groove (32) of the corresponding column (16). The cart (31, 15, 31), in this way fashioned groove vertically between two positions, such that:

a high position (33) for the handling of the container (9);

a low eclipsable position (34), facing the lower niche (10).

One sees that in all cases:

(a) in handling position (in full pull, 5, 6, 7) the hooking bar (15) is kept in place on the columns (16) by removable pins (22);

(b) in eclipsed position (in interrupted pulling diagrams 5, 6, 7) it completely releases the path of the open flaps of the door (35) or any other accessories provided for in the main niche (12) or on the container's front panel (13).

I claim:

1. A fixture movable between a first operative position and a second inoperative position for attaching a container having a front panel and an upper panel, to a transversal hooking bar of a transportation and handling vehicle, the front panel having a pair of vertical spaced apart columns wherein an opening is located between the vertical columns of the container and the columns having an upper horizontal boundary, the boundary providing a common edge between the front panel and the upper panel and the upper panel having a formed ridge to receive the fixture, wherein the fixture comprises:

(a) a horizontal member disposed between and connected to each of the two vertical columns of the front panel, to form a removable horizontal hooking bar to receive the transversal hooking bar of the vehicle; and (b) a locking means for securing the removable fixture to the front panel of the container.

2. The fixture of claim 1 further comprising: a rectangular bracket having two vertical spaced apart side members, and wherein the horizontal member is disposed between and connected to each of the two vertical side members.

3. The fixture of claim 2 wherein the locking means comprises: (a) a first pair of yokes and (b) a second pair of yokes, and wherein each of the yokes has U-shape, comprising two horizontally extending members and a vertical member and further wherein the vertical members of the first pair of yokes are mountable on each of the vertical spaced apart sides of the fixture and the vertical members of the second pair of yokes are mounted on each of the vertical columns of the front panel of the container, the horizontally extending members of the first pair of yokes and the horizontally extending members of the second pair of yokes having corresponding apertures, the apertures of the first pair of yokes aligning with the apertures of the second pair of yokes to receive a fastening means.

4. The fixture of claim 2 wherein the horizontal member is disposed between and connected to each of the two vertical sides of the movable fixture and is located at a distance approximately medial the length of the vertical side members.

5. The movable fixture of claim 4 further comprising: a second horizontal member disposed between and connected to each of the two vertical sides, the second horizontal member being located at the upper horizontal boundary of the column on the front panel of the container when the horizontal member is locked in position.

6. The movable fixture of claim 5 wherein the second horizontal member includes a pivotal axis, the pivotal axis allowing the fixture to pivot about the axis onto the upper panel of the container.

7. The movable fixture of claim 5 further comprising a resilient means for readjustment of the frame, the resilient means allowing the frame to swing up on its pivotal axis and allowing the frame to rest in the formed ridge of the upper panel of the container, with the hooking bar at the back of the upper panel.

8. The movable fixture of claim 7 wherein the resilient means for pivoting the frame onto upper panel of the container comprises a spring.

9. The fixture of claim 4 further comprising a locking means comprising a pair of removable pins insertable into the vertical side members of the movable fixture.

10. The fixture of claim 1 further comprising: a pair of siding bases, generally rectangular in shape and connected to the horizontal member disposed between and connected to each of the vertical columns on the front panel, and wherein the first base is located on one vertical column and the second base is located on the other vertical column, the horizontal member and rectangular bases, forming a horizontal bar for receipt of the transverse hooking bar.

11. The fixture of claim 10 wherein: the vertical columns of the front panel have grooves formed therein and the bases and the connected horizontal bar are slidable in the formed grooves of the vertical columns on the front panel.

12. The fixture of claim 10 further comprising a locking means for securing the sliding fixture to the bottom of the front panel of the container.

13. The fixture of claim 12 wherein the locking means comprises a pair of removable pins, insertable through the vertical columns of the front panel and the sliding bases of the removable fixture.

14. The fixture movable between a first operative position and a second inoperative position for attaching a container having a front panel and an upper panel to a transversal hooking bar of a transportation and handling vehicle, the front panel of the container having a pair of vertical spaced apart columns wherein an opening is located on the front panel between the vertical spaced apart columns, the columns having an upper horizontal boundary which provides a common edge between the front panel and upper panel and the upper panel having a formed ridge to receive the fixture, the fixture comprising:

(a) a pair of vertical side members and a pair of horizontal members, the first horizontal member being disposed between and connected to each of the two vertical sides of the movable fixture at a distance approximately medial the length of the vertical side members, the second horizontal member being disposed between and connected to each of the two vertical sides at the upper horizontal boundary of the columns on the front panel of the container; and (b) a locking means for securing the removable fixture to the front panel of the container comprising a pair of removable pins insertable through the vertical columns of the front panel into the vertical sides of the movable fixture.

15. The movable fixture of claim 14 wherein the second horizontal member comprises a pivotal axis, allowing the device to pivot about the axis to a position on the upper panel of the container wherein the frame rests in the formed ridge of the upper panel.

16. A fixture movable between a first operative position and a second inoperative position for attaching a container having a front panel and an upper panel, to a transversal hooking bar of a transportation and handling vehicle, the front panel having a pair of vertical spaced apart columns wherein an opening is located between the vertical spaced apart columns of the front panel and the vertical columns having formed grooves running the length of the column, the columns having an upper horizontal boundary wherein the upper horizontal boundary forms a common edge between the front panel and the upper panel, the upper panel also having a formed ridge to receive the fixture, wherein the fixture comprises: (a) a horizontal member disposed between and connected to each of the two vertical columns on the front panel; (b) a pair of sliding bases, the bases being generally rectangular in shape and connected to the horizontal member, wherein the first base is located on one vertical column and the second base is located on the opposite vertical column, the horizontal member and rectangular bases forming a horizontal bar for receipt of the transverse hooking bar; and (c) a locking means for securing the fixture to the front panel of the container.

17. The fixture of claim 16 wherein the bases and connected horizontal bar are slidable in the formed grooves of the vertical columns on the front panel.

18. The Fixture of claim 16 wherein the locking means comprises a pair of removable pins, insertable through the vertical columns of the front panel and the sliding bases of the removable fixture.

* * * * *